United States Patent [19]

Brock

[11] Patent Number: 4,581,102

[45] Date of Patent: Apr. 8, 1986

[54] COPPER-BASE ALLOY CLEANING SOLUTION

[75] Inventor: Andrew J. Brock, Cheshire, Conn.

[73] Assignee: Olin Corporation, New Haven, Conn.

[21] Appl. No.: 642,276

[22] Filed: Aug. 20, 1984

[51] Int. Cl.[4] ..... C23F 1/00; B44C 1/22; C03C 15/00; C03C 25/06

[52] U.S. Cl. ..... 156/645; 134/3; 134/41; 156/656; 156/657; 156/666; 156/667; 252/79.3

[58] Field of Search ..... 156/645, 656, 666, 657, 156/667; 134/3, 41; 252/79.2, 79.3, 142

[56] References Cited

U.S. PATENT DOCUMENTS

| | | | |
|---|---|---|---|
| 3,598,741 | 8/1971 | Kanno | 252/79.3 |
| 3,646,946 | 3/1972 | Ford et al. | 134/3 |
| 3,728,155 | 4/1973 | Ford et al. | 134/3 |
| 3,794,523 | 2/1974 | Thompson | 134/3 |
| 3,804,689 | 4/1974 | O'Connor | 156/233 |
| 3,860,467 | 1/1975 | Lim | 252/79.3 X |
| 4,002,489 | 1/1977 | Hedqvist et al. | 134/28 |
| 4,009,115 | 2/1977 | Binns | 252/142 |
| 4,105,469 | 8/1978 | Megy et al. | 134/3 |
| 4,124,407 | 11/1978 | Binns | 134/3 |
| 4,220,706 | 9/1980 | Spak | 430/318 |

OTHER PUBLICATIONS

ASM Committee, "Cleaning and Finishing of Copper and Copper Alloys", *Metals Handbook,* 8th Edition, vol. 2, pp. 635-647.

*Primary Examiner*—William A. Powell
*Attorney, Agent, or Firm*—Barry L. Kelmachter; Howard M. Cohn; Paul Weinstein

[57] ABSTRACT

The present invention relates to a cleaning solution for removing surface oxides from copper base alloys without significantly etching the copper-base alloy material. The cleaning solution comprises from about 1 v/o to about 50 v/o hydrofluoric acid and from about 5 v/o to about 50 v/o of at least one of sulfuric acid and hydrochloric acid. In a preferred embodiment, the cleaning solution consists essentially of from about 5 v/o to about 15 v/o hydrofluoric acid and from about 25 v/o to about 50 v/o sulfuric acid and the balance essentially water.

15 Claims, 2 Drawing Figures

COPPER-BASE ALLOY CLEANING SOLUTION

The present invention relates to the cleaning of copper-base alloys.

The proper cleaning of metal surfaces is an indispensable prerequisite for taking full advantage of a metal's desirable properties. The presence of surface contaminants such as scales, rust, corrosion, oxides, stains and other deposits can severely detract from such properties as solderability and formability and from the metal having a commercially acceptable appearance. The type of cleaning technique employed to remove unwanted contaminants generally depends upon the nature of the contaminants to be removed and the degree of cleanliness required. Acid solutions containing either sulfuric acid or hydrochloric acid are generally used to clean copper-base alloy materials. Where heavily scaled materials are to be cleaned, a bright dip cleaning solution containing sulfuric and nitric acids in varying proportions and a small amount of water and/or hydrochloric acid is often used. Some of the more conventional copper-base alloy cleaning solutions are described in "Cleaning and Finishing of Copper and Copper Alloys", *Metal Handbook*, 8th Edition, Vol. 2, pp. 635–647.

Unfortunately, the conventional copper-base alloy cleaning solutions do not lend themselves to the removal of certain surface oxides such as $Al_2O_3$, $SiO_2$ and $ZrO_2$. To remove these surface oxides, specialized cleaning techniques have had to be developed. In one such technique, the metal to be cleaned is first immersed in a hot alkaline solution such as a NaOH solution and thereafter, immersed in hot mineral acid solution such as sulfuric acid solution. U.S. Pat. Nos. 3,646,946 and 3,728,155, both to Ford et al., illustrate this type of cleaning technique. In another cleaning technique, an oxidizing solution such as a hydrogen peroxide-sulfuric acid solution or a ferric sulfate solution is used to remove chemically resistant oxide films. In this technique, the removal of the oxide film is accomplished by dissolution of the alloy at the metal-oxide interface with undercutting of the oxide followed by its eventual mechanical removal from the surface. However, in some alloys, such as Cu-Zr alloys, the oxide particles are dispersed throughout the alloy as a result of the casting process. Dissolution of the alloy surface would serve only to expose particles previously contained in the alloy. This latter technique would be inappropriate for cleaning such alloys.

In yet another technique for removing oxides of silicon from copper-base alloys, the material to be cleaned is immersed in a hydrofluoric acid cleaning solution. Cleaning solutions having a composition containing 5%–15% $H_2SO_4$ and 0.5%–5% HF or 40%–50% $H_2SO_4$, 0.5%–5% HF and 15%–20% $HNO_3$ have been used at room temperature. The metal is immersed in the cleaning solution for a time period in the range of 0.5 to 10 minutes for the $H_2SO_4$-HF solution or for a time period in the range of 5 to 45 seconds for the $H_2SO_4$-HF-$HNO_3$ solution. The use of this cleaning technique is described in the aforementioned *Metals Handbook* article. It is also known to use a hydrofluoric acid solution to remove a thin copper film from a copper oxide containing substrate. U.S. Pat. No. 3,804,689 to O'Connor illustrates this use of a hydrofluoric acid solution.

Cleaning compositions containing hydrofluoric acid have been used in the art to clean the surfaces of metals such as stainless steels, heat-resisting steels, titanium, aluminum, zirconium, hafnium and their alloys. These cleaning compositons generally comprise hydrofluoric acid in combination with one or more of sulfuric acid, nitric acid and hydrogen peroxide. U.S. Pat. Nos. 3,598,741 to Kanno, 4,002,489 to Hedqvist et al., 4,009,115 to Binns, 4,105,469 to Megy et al. and 4,220,706 to Spak illustrate some of the solutions used to clean the surfaces of non-copper-base metals and metal alloys.

In accordance with the present invention, a technique for cleaning copper-base alloys is described. The technique comprises immersing the copper-base alloy material to be cleaned in a $H_2SO_4$:HF mixture. It has been found that the use of such a cleaning solution is particularly advantageous for removing any $Cu_2O$ tarnish film and for dissolving oxide particles, such as $ZrO_2$ particles, present at the metal surface. Since there is negligible dissolution of the copper itself, underlying oxide particles, if any, are not exposed. It has also been discovered that the cleaning technique of the present invention can improve the solderability properties of the metal being cleaned and can facilitate certain fabrication techniques such as die forming a tube.

Cleaning solutions in accord with the present invention contain from about 1% to about 50% hydrofluoric acid, from about 5% to about 50% of at least one of sulfuric acid and hydrochloric acid and the balance essentially water. In a preferred embodiment, the cleaning solution composition comprises an aqueous solution containing from about 5% to about 15% hydrofluoric acid and from about 25% to about 50% sulfuric acid. As used herein, the foregoing percentages are volume percentages.

In using this technique, it has been found to be desirable to maintain the cleaning solution of the present invention at a temperature in the range of about 40° C. to about 80° C., preferably from about 50° C. to about 65° C. and to immerse the material to be cleaned in the solution for about 1 second to about 2 minutes, preferably for about 10 seconds to about 40 seconds.

The cleaning technique described herein has been found to be particularly useful for cleaning non-silicon containing copper base alloys such as Cu-Zr and Cu-Be alloys. It has also been found that the force needed to form a tube by pulling a copper-base alloy strip material through a tube forming die may be reduced by first immersing the strip material in the cleaning solutions of the present invention.

Accordingly, it is an object of the present invention to provide a process for cleaning copper-base alloy materials in an efficient and expeditious manner.

It is a further object of the present invention to provide a cleaning process as above which promotes subsequent processing and/or fabrication of the material being cleaned.

It is a further object of the present invention to provide a process as above which assists in reducing the force needed to form a tube from a copper-base alloy material.

These and further objects and advantages will become more apparent from the following description and drawings wherein like reference numerals depict like elements.

Figure 1:
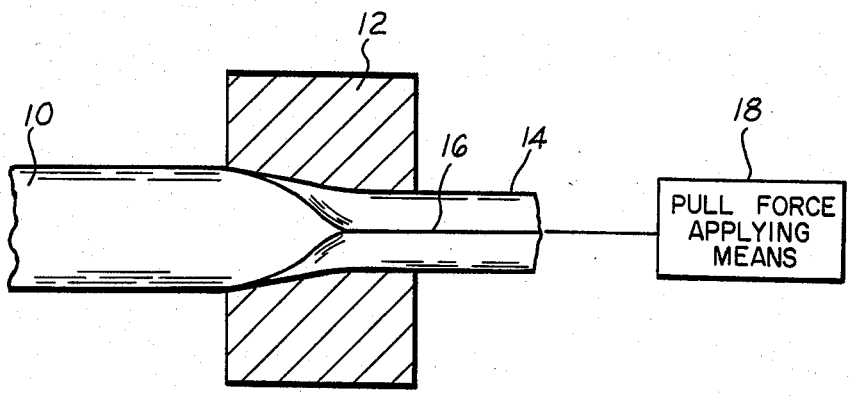
FIG. 1 is a cross-sectional view of a die for forming a strip of metal into a tube.
Figure 2:
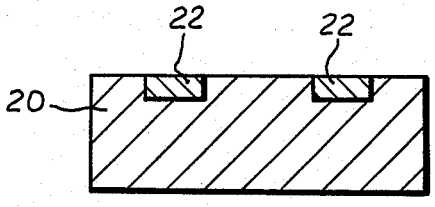
FIG. 2 is a cross-sectional view of a metal strip having inlaid metal stripes.

In accordance with the present invention, a process for effectively cleaning copper-base alloys to remove unwanted surface oxides is provided. This process is suitable for both continuous cleaning of strip material and batch cleaning of fabricated parts. It is particularly suitable for cleaning materials and parts which are to be subjected to further processing and fabrication.

The cleaning solutions of the present invention generally comprise an aqueous acidic solution containing hydrofluoric acid. The composition of the cleaning solution consists essentially of from about 1% to about 50% hydrofluoric acid, from about 25% to about 50% of at least one acid selected from the group of sulfuric acid, hydrochloric acid and mixtures thereof, and the balance essentially water. In a preferred cleaning solution embodiment, the cleaning solution consists essentially of from about 5% to about 15% hydrofluoric acid, from about 25% to about 50% sulfuric acid, and the balance essentially water. As previously mentioned, the above percentages are volume percentages.

To promote cleaning of the copper-base alloy materials in a time commensurate with commercial operations, it has been found to be desirable to maintain the temperature of the cleaning solution in the range of about 40° C. to about 80° C., preferably at a temperature in the range of about 50° C. to about 65° C. Using a cleaning solution in accordance with the present invention and maintaining the temperature of the solution within the above ranges, it is possible to clean copper-base alloy materials by immersing the material to be cleaned in the solution for a time in the range of about 1 second to about 2 minutes. Preferably, the immersion time is within a range of about 10 seconds to about 40 seconds.

The cleaning process of the present invention comprises providing a hydrofluoric acid cleaning solution in accord with the present invention in a tank not shown or other container and immersing the copper-base alloy material in the hydrofluoric acid cleaning solution. The temperature of the cleaning solution and the immersion time should be consistent with the aforementioned temperature and time ranges.

It has been found that the cleaning solutions of the present invention have particularly utility in cleaning and preparing non-silicon containing copper-base alloys, such as Cu-Zr and Cu-Be alloys, for further processing and/or fabrication. The cleaning technique of the present invention is believed to impart to those copper base alloy materials improved properties such as improved solderability, improved surface appearance, reduced friction coefficients and improved tool wear. For example, the cleaning technique of the present invention provides certain advantages when used to clean a copper-base alloy strip material 10, such as a strip of Cu-Zr alloy, prior to it being formed into a tube by being pulled through at least one tube forming die 12. It has been found that by first treating the strip material in accordance with the present invention, the force needed to be applied by a force applying means 18 such as a take-up reel, a capstan or the like to pull the strip material 10 through the tube forming die 12 may be reduced. This is believed to be due to the reduction in friction coefficient caused by the cleaning treatment.

The importance of this discovery is particularly significant in those situations where a tube 14 is to be formed from thin narrow strips e.g. the fabrication of optical fiber containment tubes for optical fiber cable assemblies. In those situations, the frictional forces created in the tube forming die 12 can lead to the tensile failure of the thin, narrow strip 10. By cleaning the thin, narrow strip material in accordance with the present invention prior to passing it through the tube forming die, this problem can be substantially eliminated. In addition, the cleaning technique of the present invention improves the solderability of the copper-base alloy material so that an improved sealing effect can be obtained when the seam 16 formed during the tube forming process is substantially filled with a sealing material such as a solder or a brazing material.

It has also been discovered that the cleaning technique of the present invention may be used to improve the surface appearance and the solderability of a strip 20 of Cu-Be alloy having one or more inlay or onlay stripes 22 without harming the inlay(s) or onlay(s). The inlay or onlay stripes 22 may be formed from any metal or metal alloy such as gold. Typically, such a material is cleaned with an etching solution such as a sulfuric acid-nitric acid mixture. Such solutions dissolve a considerable amount of metal while etching the surface. As a result, the treated metal material has a matte appearance which is commercially unacceptable. This problem does not occur using the cleaning technique of the present invention because little, if any, etching of the metal surface occurs. Further, the stripe or stripes and the Cu-Be alloy/strip metal or metal alloy interfaces should be unaffected by the treatment. This aspect of the present invention has particular significance in the processing of electronic materials.

To demonstrate the present invention, the following examples were caused to be performed.

EXAMPLE I

To demonstrate the ability of a cleaning solution in accordance with the present invention to remove surface oxides, 36,100 feet of Copper Alloy 151 strip material was cleaned by passing the material through a container holding a 25% $H_2SO_4$–5%HF cleaning solution at 55° C. at a line speed such as to produce a residence or immersion time in the solution of about 20 seconds. Copper Alloy 151 is a copper-zirconium alloy having a nominal composition of about 0.05%–0.15% zirconium by weight and the balance essentially copper. Copper Alloy 151 is manufactured and sold by Olin Corporation.

Analysis of the acid solution following treatment revealed 37 ppm copper and 40 ppm zirconium. Since the alloy contains only about 0.05–0.15% zirconium, this is a clear illustration of the removal of zirconium rich material such as particles of zirconium oxide. The copper content corresponds to the removal of an oxide layer such as $Cu_2O$ having a thickness of about 75 Å which is typical of the room temperature formed oxide on copper in air. No bulk dissolution of the alloy was observed.

EXAMPLE II

To demonstrate the improvement in solderability which can be obtained using the cleaning technique of the present invention, samples of copper alloy 151 were cleaned by the various methods shown in Table I below. Each sample had a gauge of about 0.01 inches.

TABLE I

| Cleaning Solution/ Method | Immersion Time (sec) | Solder Class |
|---|---|---|
| None | — | 3–4 (P)* |
| 12 w/o $H_2SO_4$ at 50° C. | 15 | 3 (P) |

TABLE I-continued

| Cleaning Solution/ Method | Immersion Time (sec) | Solder Class |
|---|---|---|
| | 30 | 3 (P) |
| 50 v/o $H_2SO_4$ at 50° C. | 15 | 3 |
| | 30 | 3 |
| Boiling 1N. NaOH— | 10 | 2b-3 |
| 12 w/o $H_2SO_4$ at 50° C. | 15 | 2b-3 |
| | 30 | 3 (P) |
| Boiling 1N. NaOH— | 15 | 4 |
| 12 w/o $H_2SO_4$ + 3 v/o | 30 | 4 |
| $H_2O_2$ at 43° C. | | |
| Boiling 1N. NaOH | 15 | 3-4 |
| 12 w/o $H_2SO_4$ at 50° C. | 15 | 3 |
| Boiling 1N. NaOH | | |
| 12 w/o $H_2SO_4$ + 3 v/o | 15 | 4 (P) |
| $H_2O_2$ at 43° C. | 30 | 4 (P) |
| | 60 | 4 (P) |
| Wire Nail Brush | — | 4 (P) |
| Steel Rotary Wire Brush | — | 4 (P) |
| 320 grit paper | — | 4 (P) |
| 50 v/o $H_2SO_4$ + 5 v/o HF | 10 | 2b |
| at 50° C. | 15 | 1-2b |
| | 20 | 1-2b |
| 12 w/o $H_2SO_4$ + 5 v/o HF | 10 | 2b |
| at 50° C. | 15 | 2b-3 |
| | 20 | 2b-3 |
| 12 w/o $H_2SO_4$ + 5 v/o HF | 15 | 3 |
| at 25° C. | | |
| 25 v/o $H_2SO_4$ + 5 v/o HF | 10 | 2b-3 |
| at 50° C. | 15 | 2b-3 |
| | 20 | 1 |
| 25 v/o $H_2SO_4$ + 5 v/o HF | 15 | 2b |
| at 25° C. | | |
| 25 v/o $H_2SO_4$ + 5 v/o HF | 10 | 2b-3 |
| at 50° C. | 15 | 1-2b |
| | 20 | 1-2b |
| | 25 | 1-2b |
| 25 v/o $H_2SO_4$ + 5 v/o HF | 20 | 2b-3 |
| at 25° C. | | |
| 25 v/o $H_2SO_4$ + 5 v/o HF | 15 | 1-2b |
| at 65° C. | | |
| 25 v/o $H_2SO_4$ + 1 v/o HF | 10 | 3 |
| at 50° C. | 15 | 2b |
| | 20 | 2b-3 |
| 25 v/o $H_2SO_4$ + 1 v/o HF | 15 | 2b-3 |
| at 25° C. | | |
| 25 v/o $H_2SO_4$ + 2 v/o HF | 10 | 2b |
| at 50° C. | 15 | 2b-3 |
| | 20 | 3 |
| 25 v/o $H_2SO_4$ + 2 v/o HF | 15 | 2b-3 |
| at 25° C. | | |
| 25 v/o $H_2SO_4$ + 4 v/o HF | 10 | 2 |
| at 50° C. | 15 | 2b-3 |
| | 20 | 2b |
| 25 v/o $H_2SO_4$ + 4 v/o HF | 15 | 2b-3 |
| at 25° C. | | |
| 25 v/o $H_2SO_4$ + 10% HF | 15 | 1-2b |
| at 50° C. | | |
| 25 v/o $H_2SO_4$ + 10% HF | 15 | 2b-3 |
| at 25° C. | | |

*(P) indicates large pinholes

The solderability of each cleaned sample was determined by immersing the samples in a 60-40 Sn-Pb solder bath at 238° C. for 5 seconds using an alpha 100 flux. The cleanliness of the alloy sample was then determined from an assessment of the solder coating. The solder coatings were classified in accordance with the following classification system.

Class 1. Smooth mirror-like coating

Class 2. Irregular surface but no pinholes or dewetting

Class 2a. Up to 5% dewet but no pinholes

Class 2b. Up to 5% pinholes

Class 3. Up to 50% dewetting and/or 10% pinholes

Class 4. Greater than 50% dewetting and/or 10% pinholes

Class 5. No wetting

The results in Table I show that the commonly used non-etching solutions of 12%$H_2SO_4$, 50%$H_2SO_4$, or the caustic solution-mineral-acid process do not fully clean the samples. The use of solutions which etch such as those containing hydrogen peroxide lead to decreases in the solder class. It is believed that this is due to additional zirconium oxide particles being exposed as the metal is removed. Similarly, mechanical abrasion of the samples does not yield good solderability. Such mechanical treatment likely has the same effect as an etching solution since zirconium oxide is much more abrasive resistant than the alloy matrix.

The effect of the $H_2SO_4$-HF solutions in improving the solderability of the alloy is clearly shown in Table I. It does appear from these test results that the effect of the hydrofluoric acid is related to the sulfuric acid content. The most favorable conditions at which a class 1-2b coating may be obtained appear to be 25 vol % $H_2SO_4$ and 5 vol % HF at 50° C. with an immersion time of 15 seconds. It is also clear from the test results that maintaining the hydrofluoric acid-sulfuric acid cleaning solution at room temperature is not as effective.

EXAMPLE III

To further demonstrate the effect of the cleaning technique of the present invention on subsequent processing/fabrication of a copper-base alloy material, thirty foot sample lengths of copper alloy 151 strip material having a width of about 0.313 inches and a 0.010 inch gauge were cleaned as shown in Table II below. After being cleaned, each thirty foot length was pulled through a drawing die using a commercial lubricant based on esters of fatty acids with the drawing force or pull force being measured by means of a load cell connected to the die. The sample which had been degreased only required a draw force of 185 lbs. The sulfuric acid cleaned sample required a slightly decreased draw force of 179 lbs. The sample cleaned in a 25 vol. % $H_2SO_4$-5 vol. % HF required a pull force of only 148 lbs. This represents a 20% decrease in pull force over that necessary for the uncleaned sample. In all cases, the strip samples were drawn through the die at a contant speed of 25 feet/min.

TABLE II

| Cleaning Method | Draw Force (lbs) |
|---|---|
| Degreased | 185 |
| Degreased, cleaned 20 sec in 2% $H_2SO_4$ at 50° C. | 179 |
| Degreased, cleaned 20 sec in 25 vol. % $H_2SO_4$ + 5 vol % HF @ 55° C. | 148 |

EXAMPLE IV

Samples of a 1.25" wide strip of a Cu-Be alloy C17200 having two gold stripes on one side were cleaned by the various methods shown in Table III below. Copper alloy C17200 has a nominal composition of 1.9% beryllium and the balance essentially copper. After being cleaned, each sample was immersed in a 60-40 Sn-Pb solder bath at 238° C. for 5 seconds using a 611 flux. As in Example II, the cleanliness of each sample was determined from an assessment of the solder coating. The coatings were classified in accordance with the classification system described in Example II.

TABLE III

| Cleaning Solution | Immersion Time (Sec) | Solder Class |
|---|---|---|
| None | — | 5 |
| 12 w/o $H_2SO_4$ at 50° C. | 30 | 4B |
| 25 vol % $H_2SO_4$ + 5 | 5 | 3* |
| vol % HF at 55° C. | 10 | 2a-3* |
| | 15 | 2a* |
| | 30 | 1* |
| 25 vol % $H_2SO_4$ + 5 | 5 | 3 (P)** |
| vol % HF at 55° C. | 10 | 3** |
| | 15 | 2a** |

*On striped side
**On stripe-free side

As can be seen from the above Table, even the shortest immersion time in the $H_2SO_4$:HF cleaning mixture improved solderability. Optical examination of the samples immersed in the $H_2SO_4$:HF solution revealed little, if any, etching of the metal surface. The gold stripes and the Cu-Be alloy/gold surface interfaces were unaffected by the cleaning treatment.

If desired, materials or fabricated parts cleaned in accordance with the present cleaning technique may be subjected to a water rinse and/or an air wipe before further processing and/or fabrication.

While it is preferred not to mechanically clean the copper-base alloy materials or parts prior to the cleaning treatment of the present invention, they may be so cleaned if desired.

As used herein, the term non-silicon containing copper base alloys means copper-base alloys that may have impurity levels of silicon but do not have significant levels of silicon.

The patents and article set forth in the specification are intended to be incorporated by reference herein.

It is apparent that there has been provided in accordance with this invention a copper-base alloy cleaning solution which fully satisfies the objects, means, and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

I claim:

1. A solution for removing surface oxides from non-silicon containing copper base alloys, said solution consisting essentially of from about 5 v/o to about 15 v/o hydrofluoric acid, from about 25 v/o to about 50 v/o sulfuric acid and the balance essentially water.

2. The solution of claim 1 wherein said solution is maintained at a temperature in the range of about 50° C. to about 65° C.

3. The solution of claim 1 wherein said solution is maintained at a temperature in the range of about 40° C. to about 80° C.

4. A process for removing oxide particles from a material formed from a non-silicon containing copper base alloy, said process comprising immersing said material in a solution containing from about 1 v/o to about 50 v/o hydrofluoric acid and from about 5 v/o to about 50 v/o of at least one of sulfuric acid and hydrochloric acid for a time in the range of about 1 second to about 2 minutes.

5. The process of claim 4 further comprising:

maintaining said solution at a temperature in the range of about 40° C. to about 80° C.

6. The process of claim 4 further comprising:

maintaining said solution at a temperature in the range of about 50° C. to about 65° C.

7. The process of claim 4 wherein said immersing step comprises immersing said material in said solution for a time period in the range of about 10 seconds to about 40 seconds.

8. A process for removing oxide particles from a material formed from a non-silicon containing copper base alloy, said process comprising immersing a material formed at least in part from a copper-beryllium alloy in a solution containing from about 1 v/o to about 50 v/o hydrofluoric acid and from about 5 v/o to about 50 v/o of at least one of sulfuric acid and hydrochloric acid.

9. The process of claim 8 wherein said material comprises a strip of copper-beryllium alloy having at least one gold stripe bonded thereto.

10. A process for removing oxide particles from a material formed from a non-silicon containing copper base alloy, said process comprising immersing a material formed from a copper base alloy consisting essentially of from 0.05% to 0.15% zirconium and the balance essentially copper in a solution containing from about 1 v/o to about 50 v/o hydrofluoric acid and from about 5 v/o to about 50 v/o of at least one of sulfuric acid and hydrochloric acid.

11. A process for removing oxide particles from a material formed from a non-silicon containing copper base alloy, said process comprising immersing said material in a solution consisting essentially of from about 5 v/o to about 15 v/o hydrfluoric acid and from about 25 v/o to about 50 v/o sulfuric acid and the balance essentially water.

12. A process for reducing the force needed to pull a copper-base alloy strip material through a tube forming die, said process comprising:

immersing said copper alloy strip material in a solution at a temperature in the range of about 40° C. to about 80° C., said solution containing from about 1 v/o to about 50 v/o hydrofluoric acid and from about 5 v/o to about 50 v/o of at least one of sulfuric acid and hydrochloric acid; and pulling said strip material through said die.

13. The process of claim 12 wherein said immersing step comprises:

immersing said strip material in said solution for a time in the range of about 1 sec. to about 2 minutes.

14. The process of claim 12 wherein said immersing step comprises:

immersing said strip material in said solution for a time in the range of about 10 sec. to about 40 sec.

15. The process of claim 12 wherein said immersing step comprises:

immersing said strip material in a solution at a temperature in the range of about 50° C. to about 65° C., said solution consisting essentially of from about 5% to about 15% hydrofluoric acid and from about 25% to about 50% sulfuric acid and the balance essentially water.

* * * * *